US011168956B2

(12) United States Patent
Dilling

(10) Patent No.: US 11,168,956 B2
(45) **Date of Patent: *Nov. 9, 2021**

(54) CONVERTIBLE SLING

(71) Applicant: Doughboy Tactical LLC, Huntsville, TX (US)

(72) Inventor: Joshua Dilling, Huntsville, TX (US)

(73) Assignee: Doughboy Tactical LLC, Conroe, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/997,647

(22) Filed: Aug. 19, 2020

(65) Prior Publication Data

US 2020/0378720 A1 Dec. 3, 2020

Related U.S. Application Data

(63) Continuation of application No. 16/285,347, filed on Feb. 26, 2019, now Pat. No. 10,782,093.

(51) Int. Cl.
*F41C 33/00* (2006.01)
*A45F 3/14* (2006.01)

(52) U.S. Cl.
CPC ..... *F41C 33/002* (2013.01); *A45F 3/14* (2013.01); *A45F 2003/142* (2013.01); *A45F 2200/0591* (2013.01)

(58) Field of Classification Search
CPC .... F41C 33/002; F41C 33/001; F41C 33/007; A45F 3/14; A45F 2005/006
USPC ..... 224/150
See application file for complete search history.

(56) References Cited

U.S. PATENT DOCUMENTS 3,444,957 A * 5/1969 Gilpin, Jr. ..... F16F 7/00 182/3
3,727,808 A 4/1973 Fitzgerald
3,927,808 A * 12/1975 Steen ..... F41C 33/002 224/267
4,562,945 A 1/1986 Erlandson
(Continued)

FOREIGN PATENT DOCUMENTS

GB 2306877 B 9/1995

OTHER PUBLICATIONS

Lanhe Tactical 550 Paracord 2 Point Rifle Sling Gun Strap with Shoulder Pad Adjustable Two Point Sling, available at https://www.amazon.com/dp/B071ZXFKVN/ref=sspa_dk_detail_3?osc=1&pd_r_ i=B071ZXFKVN&pf_rd_m=ATVPDKIKX0DER&pf_rd_p=f52e26da-1287-4616-824b-efc564ff75a4&pf_rd_r=9JFMGDXRH93KW6ZXJP9K&pd_rd_wg=6WCn6&pf_rd_s=desktop-dp-sims&pf_rd_t=40701&pd_rd_w=cwtjN&pf_rd_i=desktop-dp-sims&pd_rd_r=c8b7cb87-d174-11e8-b219-2f95925f1060.
(Continued)

*Primary Examiner* — Justin M Larson
(74) *Attorney, Agent, or Firm* — RegitzMauck PLLC; Michael Regitz; Dustin Mauck

(57) ABSTRACT

A sling apparatus that improves user comfort and weapon stabilization and that can be easily converted to and from single-point configuration, two-point configuration, and body armor configuration. The configuration flexibility and ease of conversion allows the user to tailor the sling apparatus to user preferences or environment. In any configuration, the sling improves the user's ability to stabilize the weapon, enhances the comfort of the user, secures the weapon more tightly to the user's body for increased weapon control, and provides an integrated source of paracord that can be utilized in emergency situations.

14 Claims, 8 Drawing Sheets

(56) References Cited

U.S. PATENT DOCUMENTS 4,853,275 A * 8/1989 Tracy ..... A41F 15/005 428/178
5,205,803 A * 4/1993 Zemitis ..... A63B 21/0552 482/121
5,325,618 A * 7/1994 Turner ..... F41A 17/08 224/149
5,600,873 A * 2/1997 May ..... G02C 3/003 200/330
5,615,811 A * 4/1997 Bell ..... F41C 23/02 224/150
5,881,487 A * 3/1999 Chalker ..... F41C 33/002 42/85
6,389,655 B2 * 5/2002 Libecco ..... B60P 7/0823 24/129 R
6,427,374 B1 * 8/2002 Vaiani ..... F41C 23/02 119/770
6,776,317 B1 * 8/2004 Parker ..... A45F 5/00 224/250
D571,059 S * 6/2008 Napolitano ..... D30/153
7,458,135 B2 * 12/2008 Mikesell ..... B25H 3/006 24/300
7,665,575 B2 * 2/2010 Tanaka ..... D03D 11/00 182/3
7,794,374 B1 * 9/2010 Park ..... A63B 21/0552 482/122
7,841,496 B1 * 11/2010 Schweikert ..... F41C 33/002 224/150
7,988,023 B1 8/2011 Nykoluk
8,322,586 B2 * 12/2012 Davis ..... A45F 5/021 224/669
D682,489 S * 5/2013 Kalbach ..... D30/153
8,997,317 B2 * 4/2015 Rinklake ..... A62B 35/04 24/300
9,084,455 B2 7/2015 Millan
9,164,543 B2 * 10/2015 Minn ..... A45F 5/00
9,410,766 B1 8/2016 Falla
D767,250 S * 9/2016 Poggi ..... D2/635
9,557,138 B2 * 1/2017 Alford ..... F41C 33/002
9,587,908 B2 * 3/2017 Bjelde ..... F41C 33/002
9,630,081 B2 * 4/2017 Gillespie ..... A63B 21/0555
9,746,284 B2 8/2017 McCarthy
9,835,407 B2 12/2017 McLean
9,835,408 B2 12/2017 Parks
9,885,540 B2 2/2018 Bennett
9,915,499 B2 3/2018 Alford
9,926,652 B2 3/2018 King
10,010,163 B2 7/2018 Wells
10,281,235 B1 * 5/2019 White ..... F41C 23/02
10,782,093 B2 * 9/2020 Dilling ..... F41C 33/002
10,982,930 B2 * 4/2021 Lance ..... F41C 33/002
2006/0225253 A1 * 10/2006 Bates ..... A45F 5/02 24/3.13
2007/0278262 A1 * 12/2007 Gallagher ..... F41C 33/002 224/150
2008/0217371 A1 * 9/2008 Wemmer ..... F41C 33/00 224/579
2010/0005632 A1 * 1/2010 Pigozzi ..... B63C 11/02 24/3.13
2010/0206921 A1 * 8/2010 Shen ..... F41C 33/002 224/150
2012/0267403 A1 * 10/2012 Ward, Jr. ..... A45F 5/00 224/219
2014/0203053 A1 * 7/2014 Rivas-Schlanger ..... F41C 23/02 224/150
2014/0252051 A1 9/2014 Esch
2014/0263489 A1 * 9/2014 Hendricks ..... F41C 33/002 224/150
2015/0292834 A1 * 10/2015 McCarthy ..... F41C 33/002 224/150
2018/0202762 A1 * 7/2018 Alford ..... F41C 33/002
2020/0149842 A1 * 5/2020 Marshall ..... F41C 33/002
2020/0278174 A1 * 9/2020 Gill ..... F41C 23/02

OTHER PUBLICATIONS

2 Point Adjustable Paracord Gun Sling, available at https://www.ebay.com/itm/Eagle-Rock-Gear-2-Point-Adjustable-Paracord-Gun-Sling-Rifle-Shotgun-Crossbow-/263829804483.

* cited by examiner

CONVERTIBLE SLING

The present application claims priority under 35 U.S.C. § 120 as a continuation of U.S. application Ser. No. 16/285,347, filed Feb. 26, 2019.

TECHNICAL FIELD

The present invention relates to a tactical sling designed to optimize user comfort, weapon stabilization, and conversion among different configurations such as single-point, two-point, and body armor integration.

BACKGROUND OF THE INVENTION

Weapon slings used to facilitate the carrying of a firearm such as a rifle or a shotgun have generally been divided into single-point slings and two-point slings, each with their own advantages and limitations. Slings provide the user with an easy way to carry a weapon to reduce shoulder fatigue and without the weapon being in the user's hands at all times, which can allow the user to draw a sidearm, render assistance, or otherwise achieve a level of mobility that would be impossible were the user forced to maintain control of the rifle without the use of a sling.

A single-point sling generally consists of a support strap that wraps around the neck, across the back, underneath the armpit of the wearer, and back across the chest to form a loop around the wearer, and a connected strap that hangs down from the loop in the chest area and attaches to the weapon with its barrel pointing towards the ground. A single-point sling allows users to rapidly bring the weapon into firing position. The user can release the weapon without losing control of it as the weapon will return to the same point of rest and hang safely against the user's body, for example, when the user needs to access a sidearm. Because the weapon is attached to only one point of the sling (i.e., single-point), the weapon can be easily and quickly moved around to get into the best firing position and can be quickly disconnected from the sling due to its single connection point. However, because the point of rest will be against the user's body, the single-point sling can be a problem when the user needs to get the weapon out of the way to render assistance, climbing, crawling, etc. and the weight distribution of the weapon is poor, which makes the sling uncomfortable for use over long periods of time or when the user is on the move. Also, running with a single-point sling commonly results in the weapon knocking against your legs, which can lead to injuries or trip up the user. Present versions of single-point slings suffer from poor design characteristics that fail to properly support the weapon because it fails to counteract the weight of the weapon, which tends to slide too far down and too far to the side of the user. This causes a loss of control of the weapon, which is exacerbated when the user is walking, running, or climbing. Single-point slings also allow the user to have unrestricted access to the weapon magazine for ease of reloading.

A two-point sling generally consists of a support strap that attaches to or near the butt of the weapon and then wraps around the neck, across the back, and underneath the armpit of the wearer to attach to the weapon at or around the barrel of the weapon. A primary advantage of a two-point sling is relative comfort (compared to a single-point sling) when the user is carrying the weapon for a long period of time or over rough terrain. However, most two-point slings will cause discomfort over long distance treks, and even those slings that include padded portions that contact the shoulder and back can suffer from durability issues due to the nature of the cushioning provided. Running with a two-point sling is also much less likely to cause injury or trip up the user because the weapon is in no danger of dangling, as is often the case with a single-point sling. Further, the two-point sling can also be used in the familiar "slung over the shoulder" method of carrying the weapon, though using the sling in that manner generally requires the weapon to be unslung before reaching a stable shooting position or to transition from one shoulder to another. If the release strap of a two-point sling is fully extended, it is possible for the user to stabilize the shooting arm by wrapping the sling around the support arm.

In military applications, soldiers are often issued and outfitted with body armor vests, which can prevent the optimal fit and movement of a sling that is generally worn over the body armor vest. Although slings are generally designed to fit and adapt to various body types, the bulk and construction of body armor vests, which can be outfitted with various protectors, pockets, and other accessories, naturally complicate the normal movement of a sling and a sling can easily get hung up on the vest or an accessory.

It would be beneficial if a convertible sling (e.g., single-point, two-point, body armor compatible) were available that provided greater comfort for the wearer and that afforded the user with improved characteristics regarding stabilization, faster transitioning, weight support, and movement restriction. Sling convertibility would allow a sling to adapt to particular situations and circumstances and become a mission specific weapon accessory.

BRIEF SUMMARY OF THE INVENTION

The claimed invention is a convertible sling premised on the discovery that the fundamental problem with prior art slings is the failure to employ a combination of different materials and configurations in order to achieve a durable and comfortable sling that achieves an improved level of weapon stability. The design of the sling and the characteristics of the materials used in its composition allow for multiple configurations, improve the user's ability to stabilize the weapon when in firing position (with a single hand if necessary), enhance the comfort of the wearer even over long hiking periods, secure the weapon more tightly to the user's body for increased weapon control, and provide an integrated source of paracord that can be used in a variety of survivalist applications.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features, which are believed to be characteristic of the invention, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
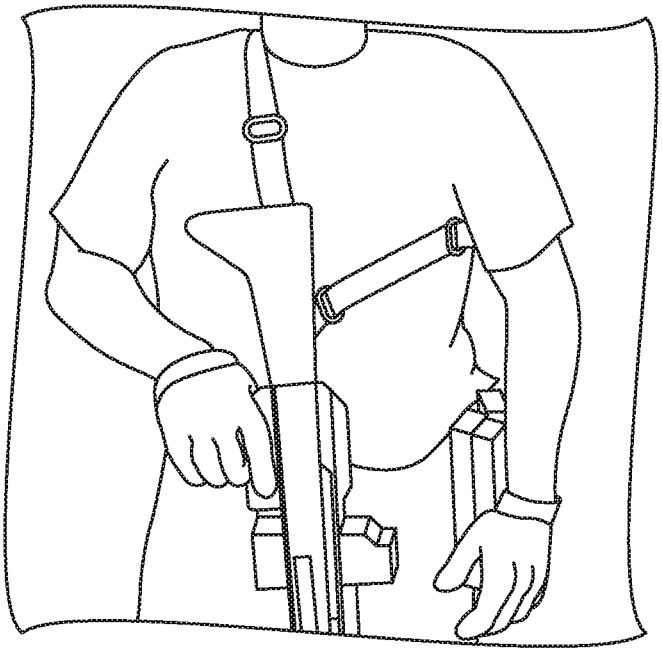
FIG. 1 depicts a user wearing a sling with a weapon in a single-point configuration.

FIG. 1 shows a user holding a weapon that is supported by a single-point sling. The sling in FIG. 1 is comprised of one or more continuous strap sections. When the user releases his grip on the weapon, the weight of the weapon tends to drag the sling down and to the right, which limits benefits of the sling that are fully realized if the butt of the weapon is secured snugly around the shoulder area. Keeping the weapon in the correct position is essential to avoiding injuries associated with losing control of the weapon. For example, if the weapon hangs too low, the weapon can interfere with movement or bounce against the user's legs. If the weapon hangs too high, the butt of the gun can hit the user in the jaw. In either of these situations, the user is forced to spend precious time dragging the weapon back into firing position. Various tightening straps are shown that allow the user to tailor the sling to his body parameters, but the sling attaches to the weapon at a single point (i.e., "single-point sling").

Figure 2:
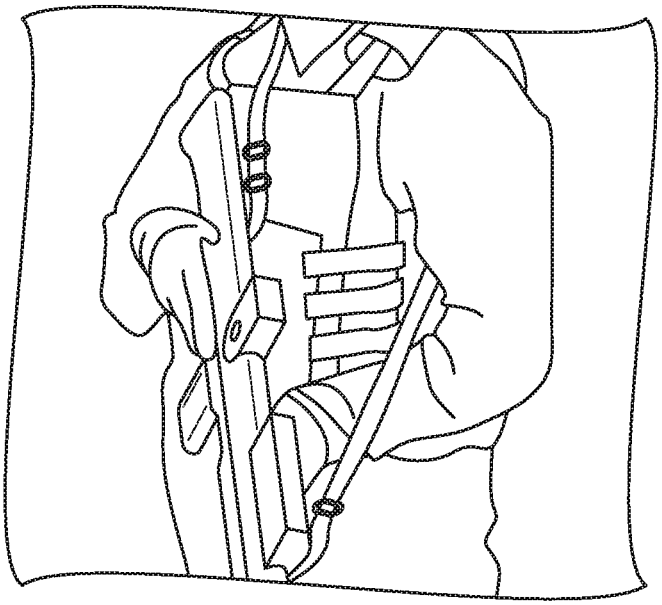
FIG. 2 depicts a user wearing a sling with a weapon in a two-point configuration.

FIG. 2 shows a user holding a weapon that is supported by a two-point sling. The sling in FIG. 2 is comprised of one or more continuous strap sections that terminate at the front and back of the weapon (i.e., sling attaches at two points or a "two-point sling").

Figure 3:
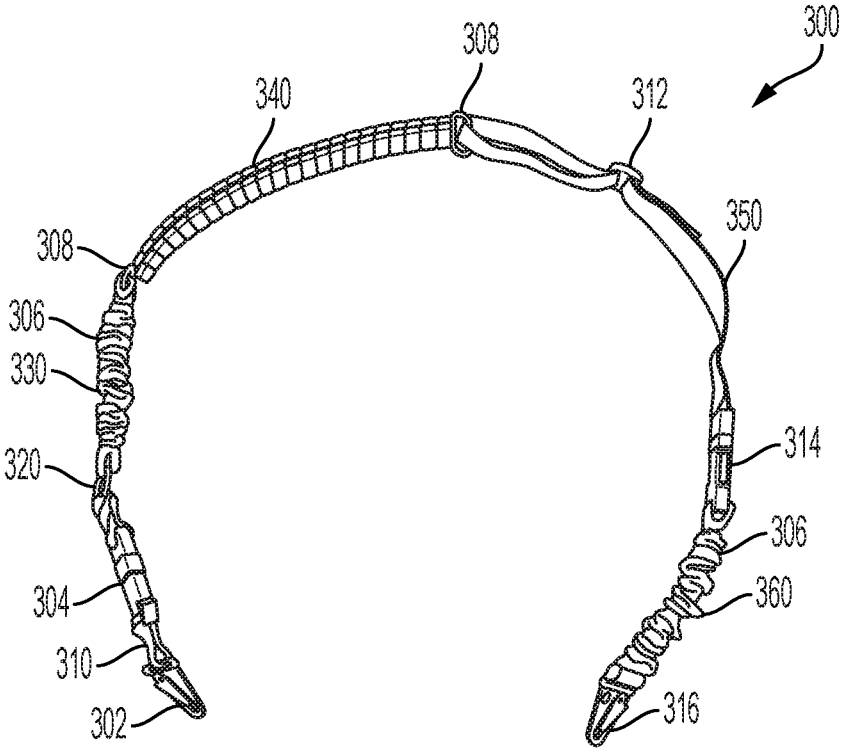
FIG. 3 is a drawing of an embodiment of the claimed invention.

FIG. 3 shows an embodiment of the claimed invention. Sling 300 can be separated into five general sections (310, 330, 340, 350, and 360). Section 310 includes snap hook 302 used to connect to the butt/rear portion of the weapon, side-release buckle 304 used to quickly disconnect the weapon from the sling 300 should the need arise, and nylon webbing or other similar strap material to facilitate the transition from snap hook 302 to side-release buckle 304 to conversion ring 320. Nylon straps or webbing can be sewn together to form loops or separate clips or other means can be used to securely fasten the components together. Section 330 connects to conversion ring 320 and is comprised primarily of shock cord covered in nylon sheath 306. Section 330 transitions to Section 340, which is comprised of a triple cobra weave 550 paracord in the preferred embodiment. Section 340 is connected to section 350, which is comprised of a nylon strap and clips or plastic loops (308, 312) that allow the user to adjust the length of the strap in order for sling 300 to fit snugly around the user's body. Section 350 is connected to section 360, which includes side release buckle 314, shock cord covered in nylon sheath 306, and snap hook 316.

Figure 4:
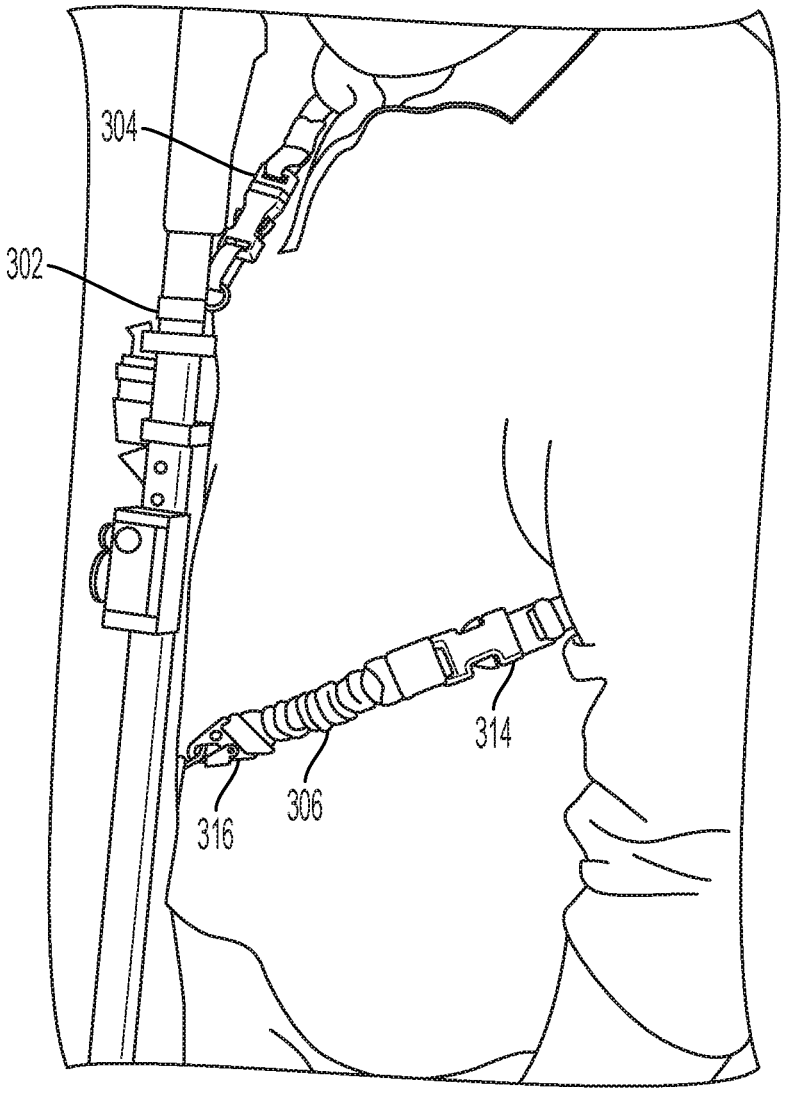
FIG. 4 is the front/side view of a user wearing an embodiment of the claimed invention with a weapon in the two-point configuration.

In the embodiment of the invention shown in FIG. 3, snap hook 302 can connect to or around the butt of the weapon and snap hook 316 can connect to the weapon towards the front of the weapon to form a two-point configuration, which is shown in FIG. 4 (view of snap hook 302 obscured by weapon).

Figure 5:
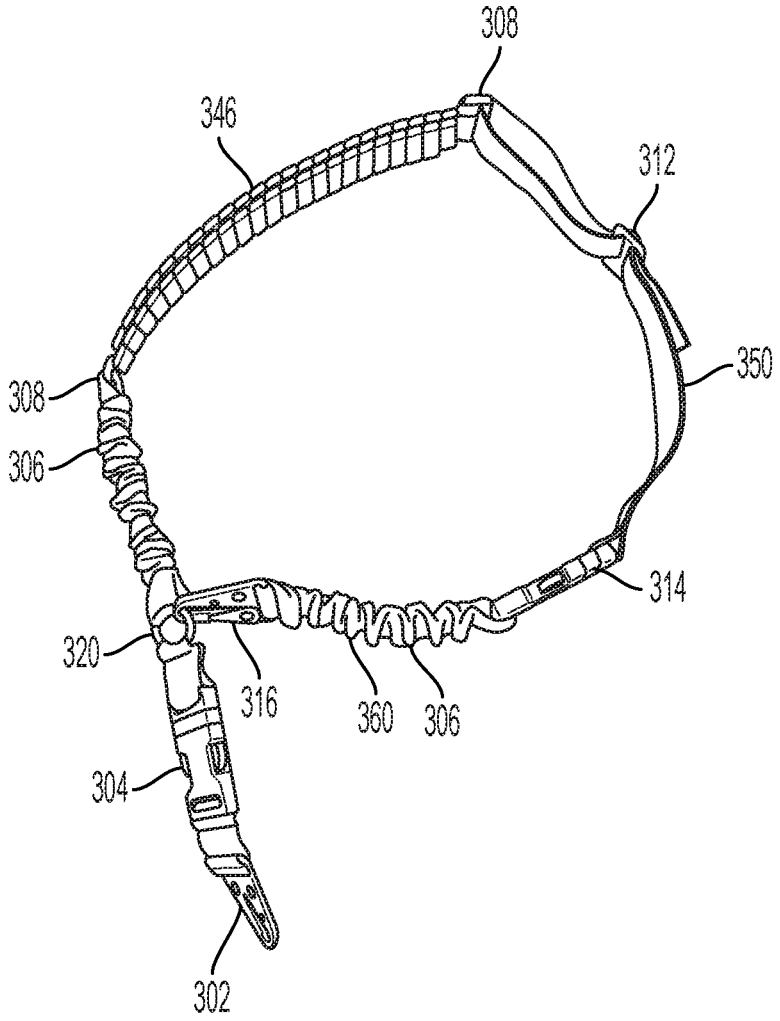
FIG. 5 is a drawing of an embodiment of the claimed invention in a single-point configuration.

Alternatively, as shown in FIG. 5, snap hook 302 can connect to or around the butt of the weapon while snap hook 316, instead of connecting to the weapon, connects to conversion ring 320, which results in section 360 coming up across the chest of the user to facilitate the single-point attachment. This comprises the conversion procedure to change sling 300 from a two-point configuration into a single-point configuration, which is exemplified by the sling of FIG. 1. In this configuration, the weapon connects to the sling at a single point (e.g., snap hook 302) and the weapon hangs downward from the single point freely across the body of the user. The conversion is just as easily reversed (i.e., from a single-point configuration to a two-point configuration) by disconnecting snap hook 316 from conversion ring 320 and connecting it to a connection point towards the front of the weapon.

In the embodiment of the invention shown in FIG. 3, Section 310 comprises snap hook 302, side-release buckle 304, and nylon webbing or strap material to facilitate the transition from snap hook 302 to side-release buckle 304 to conversion ring 320. The function of snap hook 302 is to provide a secure connection near the rear of the weapon, as exemplified by FIG. 4, which shows an embodiment of the claimed invention in a two-point configuration. Regardless of configuration, it is snap hook 302 or an alternative connection mechanism that attaches to the weapon at or around the butt of the weapon. Alternative connection mechanisms that can be used are quick release/quick detachment mechanisms or other mechanisms designed to provide a secure yet detachable connection between sling 300 and the weapon (e.g., based on the design of the weapon).

The connection point embodied by snap hook 302 is designed to provide a secure connection between sling 300 and the weapon while providing a simple and quick process to decouple the weapon from the sling connection point. For example, in embodiments of the invention using snap hook 302, the spring gate portion of snap hook 302 is normally held closed by the spring to prevent the weapon from decoupling from the sling. However, when the user wants to disconnect the weapon from the sling, the user merely actuates the spring gate and allows the weapon connection point to slide out of snap hook 302. Other quick release/quick detach mechanisms can be used and allow the weapon to be disconnected by pulling or twisting on the mechanism to facilitate decoupling. Examples include ball detach and button release latching configurations. The choice of connection mechanism used is usually driven by user preference or weapon design, but any device that allows for a secure weapon connection and a simple and/or fast disconnect process may be used.

Section 310 can also include a side-release buckle 304, which allows for an even faster and perhaps easier disconnect of the weapon from sling 300. Should the user choose to actuate side-release buckle 304 to detach the weapon from sling 300, part of sling 300 (e.g., snap hook 302, nylon strap/webbing connecting snap hook 302 to side-release buckle 304, and a portion of side-release buckle 304) will necessarily remain attached to the weapon. The weapon can then be reconnected using side-release buckle at the user's discretion and at the appropriate time. Nylon strap/webbing is then used to connect side-release buckle 304 to conversion ring 320. Although the transition element in the sling is often described as nylon strap/webbing in the specification, the transition material can be any material that is durable, weather-resistant, temperature resistant, flexible, and can be sewn together to secure dissimilar portions of sling 300 together by forming a transition point between, for example, side-release buckle 304 and transition ring 320. Alternate connection devices can also be used to transition to and from the various components that comprise section 310.

As stated above, conversion ring 320 forms the connection point that facilitates the conversion of sling 300 from a single-point configuration to a two-point configuration in an embodiment of the invention. In the embodiment shown in FIG. 3, conversion ring 320 is, in fact, a ring, and the connections between section 310 and section 330 can move around conversion ring 320 to provide for some degree of adjustment. While embodiments of the invention utilize a metal and properly treated (e.g., painted, hardened) circular ring approximately 1 inch to 1.5 inches in diameter, conversion ring 320 may be configured in other shapes (e.g., square, rectangular, triangular) or be comprised of other materials (e.g., polymer, coatings).

Section 330 is connected to conversion ring 320 and is comprised of shock cord covered in nylon sheath 306 in this embodiment. Although shock cord or reinforced bungee cord are preferred materials due to their inherent characteristics, any cord that is elastic can be used. Shock cord or bungee cord is generally comprised of one or more elastic cords that is usually covered in a woven cotton, nylon, polyester, polyethylene, or polypropylene sheath, which does not usually extend elastically, but rather compresses around the core of the elastic cord(s) when the cord is pulled longitudinally. The outer nylon sheath in the embodiment shown in section 330 is separate from the shock cord sheath (not shown in FIG. 3). The nylon sheath is shown as bunched up in section 330 and section 360 in its non-extended state, which is from 5 inches to 6 inches in length as measured between the connection points (e.g., conversion ring 320 and clip 308, side-release buckle 314 to snap hook 316) in a preferred embodiment. When in its fully extended state, which is from 9 inches to 10 inches in length as measured between the same connection points, the nylon sheath is no longer bunched up but flattens out. The nylon sheath serves a variety of purposes including increased durability, a transition element by which the shock cord can be integrated and anchored into the sling, and improved aesthetics.

Section 330 functions to secure the weapon to the user in a manner that allows some flexibility when the user raises his weapon to aim and/or fire. The elasticity of section 330 pulls the weapon into the user's shoulder in order to stabilize the weapon in firing position, when transitioning from weapon carrying techniques (e.g., from low-ready to high ready), and even if circumstances require aiming and firing with a single hand, such as in the case of injury to the other hand/arm or when the user is performing the fireman's carry technique. The user can utilize section 330 as a brace that allows him to properly aim and fire at the target. This also assists the user while in the "ready" position because sling 300 carries the weight that would normally be carried by the user when he is raising and steadying the weapon, which allows for increased accuracy and consistency while in the standing, kneeling, or sitting shooting position.

The transition between section 330 and section 340 in FIG. 3 is accomplished by clip 308, but any connection method or device that securely connects the two sections will suffice. Section 340 is comprised of "parachute cord" with a minimum breaking strength of 550 pounds (known in the art as "550 paracord"), and in the preferred embodiment, is comprised of triple cobra weave 550 paracord, which can be comprised of nylon, polyester, or similar material. Paracord is generally comprised of a braided nylon sheath having a high number of interwoven nylon strands, which are themselves comprised of finer yarns which form the inner core of the individual strands. Section 330 of sling 300 is the portion of the sling that hangs across the back in either the single-point configuration or the two-point configuration, and therefore, it is section 340 that carries the majority of the weight of the weapon. Because of this, the discomfort associated with slings is generally caused by the section of the sling that hangs across the back, especially when the user is travelling extended distances on foot. Standard straps that are commonly used in weapon slings tend to dig into the back of the user, especially during extended hikes or rucks.

The preferred embodiment of the invention solves this problem by providing a cushion in a way that is durable and that provides additional functionality for the user when confronted with various survival scenarios. Triple cobra weave 550 paracord is extremely durable and is thick enough in composition to provide excellent cushioning characteristics for sling 300. Section 340 distributes the weight of the weapon more evenly and at rounder edges than a standard strap, which provides additional comfort for the user. Further, individual strands of the triple cobra weave 550 paracord can be removed from section 340 and used for a variety of applications including hunting, fishing, or camping due to its balance of strength (i.e., 550 pound tensile strength) and flexibility. Individual core threads of each strand of 550 paracord can also be broken down and used a thread for sewing. These applications are associated with activities in which weapon slings are commonly used. The triple weave configuration allows the user to remove two layers of the cord to be used for such applications while still allowing sling 300 to be functional as a sling in the single-point configuration or the two-point configuration.

Section 340 is then connected to section 350, again by clip 308 in the embodiment shown in FIG. 3, but any connection method or device that securely connects the two sections will suffice. Section 350 can be comprised of a nylon strap and one or more adjusting clips or plastic loops (308, 312) that allows the user to adjust the overall length of the strap in order for sling 300 to fit snugly around the body, but any strap configuration that facilitates sling adjustment based on user body characteristics can be used. In the embodiment shown in FIG. 3, clip 312 is a plastic tri-glide slide or bar clip that allows the user to adjust the overall length of sling 300.

Section 350 is connected to section 360, which includes side-release buckle 314, shock cord covered in nylon sheath 306, and snap hook 316. Section 350 may be directly connected to side-release buckle 314, which like side-release buckle 304 allows the user to quickly and easily detach the weapon from sling 300 while part of section 360 remains attached to the weapon. In the single-point configuration, with snap hook 316 connected to conversion ring 320, shock cord covered in nylon sheath 306 stretches across the chest of the user to provide a snug fit, which further stabilizes sling 300 against the user, which in turn prevents the weapon from falling downward and to the side of the user and away from the optimum rest position for the weapon. However, shock cord covered in nylon sheath 306 is elastic enough that it does not constrict the user's breathing. Snap hook 316 either attaches to conversion ring 320 for a single-point configuration or towards the front of the weapon for a two-point configuration, which is shown in FIG. 4. Shock cord covered in nylon sheath 306, which is incorporated into section 330 and section 360, stretches to allow the user to aim and fire the weapon in both the single-point configuration and the two-point configuration while also keeping the weapon centered (as opposed to the weapon sliding down and to the side of the user, which causes loss of control and reduced reaction time).

FIG. 5 shows the embodiment of the invention that is shown in FIG. 3, but in the single-point configuration. In this configuration, snap hook 316, instead of attaching to the front portion of the weapon, attaches to conversion ring 320. In this configuration, section 360, which would normally extend down or out from the user in a two-point configuration, instead wraps up over the chest of the user to form a secure and snug single-point sling. Those skilled in the art will recognize that in embodiments where snap hook 316 is replaced with a quick detach male mount, conversion ring 320 will be configured to include a quick detach female adapter. Similar design changes necessitated by other connect/disconnect mechanisms used to form the secure connection in the single-point configuration can be easily applied by those skilled in the art based upon the various commercial connection devices and combinations available.

Figure 6:
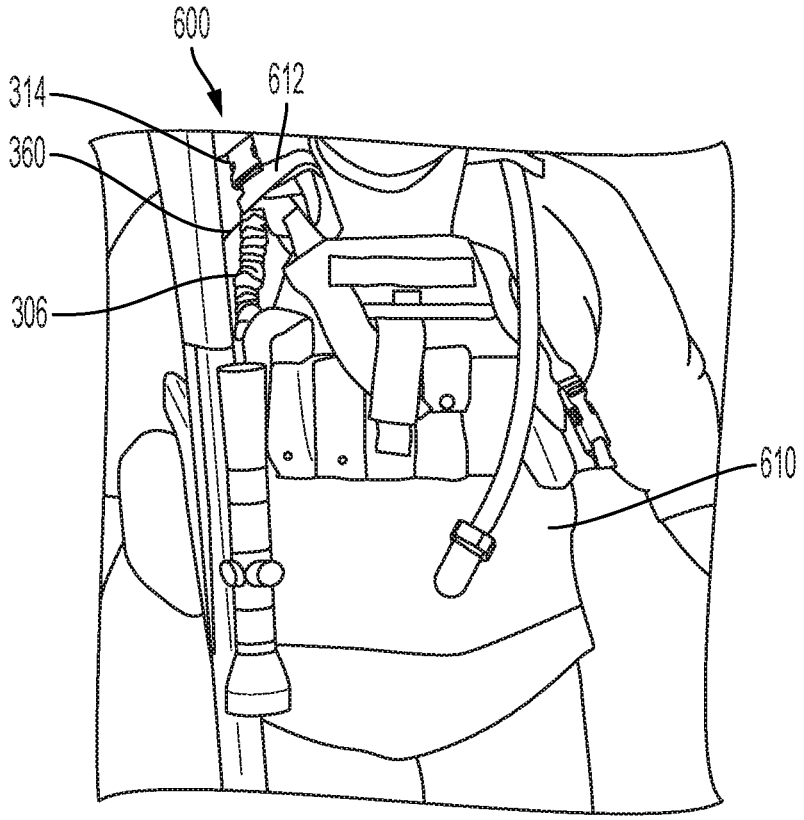
FIG. 6 is the front view of a user wearing an embodiment of the claimed invention that is integrated into a body armor vest.

FIG. 6 shows the front view an embodiment of the invention in which sling 600 is incorporated into body armor vest 610 in a single-point configuration. In this embodiment, section 350 and section 360 have been detached from the other components of the embodiment shown in FIG. 3. Once section 360 reaches the shoulder of the user, sling 600 can be held in position by strap 612 that is incorporated into body armor vest 610 in the shoulder area in the proximity of side-release buckle 314. In this way, conversion of the sling from a single-point configuration or a two-point configuration into a configuration integrated into a body armor vest is quick and easily accomplished, as the user merely needs to disconnect strap section 350 from clip 308 that joins section 340 to section 350, mount section 350 and section 360 onto body armor vest 620, and attach the weapon to slip hook 314.

Figure 7:
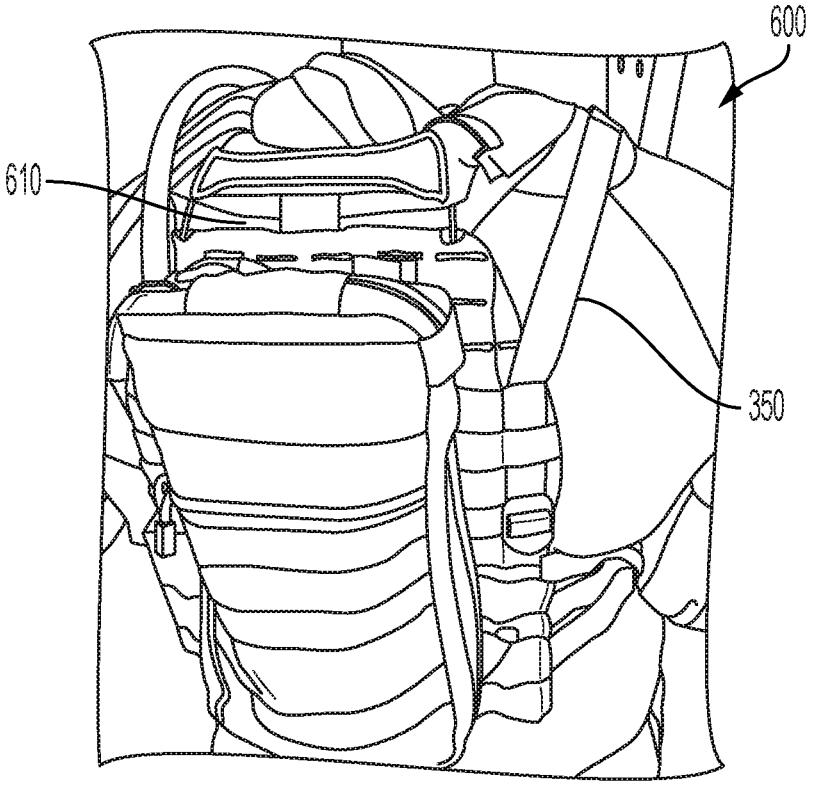
FIG. 7 is the back view of a user wearing an embodiment of the claimed invention that is integrated into a body armor vest.

FIG. 7 shows the back view of the embodiment of the invention shown in FIG. 6. As section 360 reaches the shoulder area, sling 600 transitions into section 350, which is comprised of an adjustable nylon strap and clips, and continues down the back of the user to be anchored to body armor vest 610. In this embodiment, the weight of the weapon is primarily supported by body armor vest 610, which is secured to the body of the user by virtue of its form and function.

Figure 8:
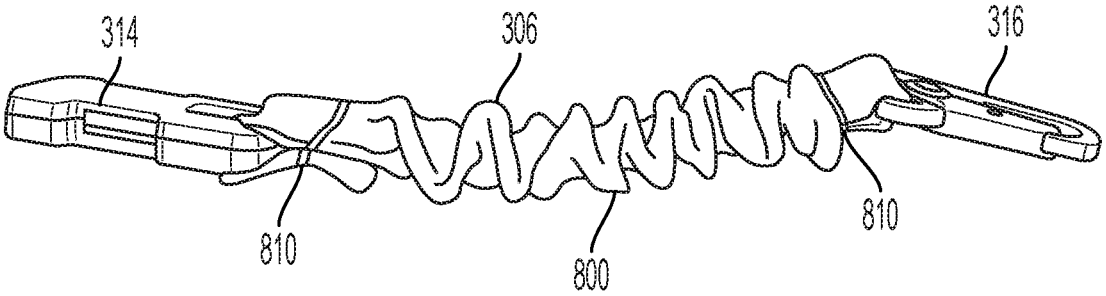
FIG. 8 is a side view of a section of an embodiment of the claimed invention.

As the descriptions of embodiments of the claimed invention make clear, shock cord covered in nylon sheath 306 provides important functionality for the sling, particularly with respect to ensuring that the sling fits snugly around the user while also providing stretching functionality for the sling, which allows for optimal stabilization of the weapon in firing position, regardless of whether the user is standing or in the prone position. FIG. 8 shows a side view of section 360 in an embodiment of the invention, beginning from detached side-release buckle 314 to snap hook 316. As shown in FIG. 8, nylon sheath 800 encloses the stretchable shock cord to provide additional durability, but also to provide a mechanism to securely fasten the shock cord to the sling by sewing the shock cord into section 360 with threads 810 that operate to attach nylon sheath 800 to side-release buckle 314 and to snap hook 316 by looping nylon sheath 800 around the respective attachment bars of side-release buckle 314 and snap hook 316.

Figure 9:
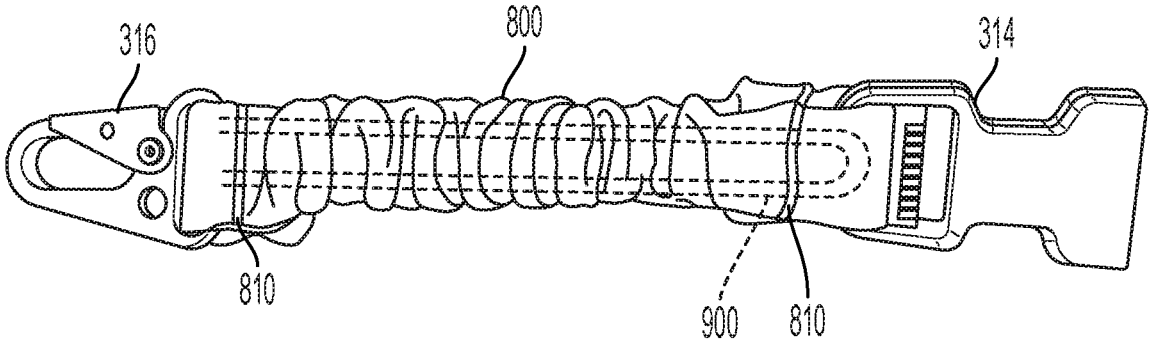
FIG. 9 is a top view of a section of an embodiment of the claimed invention.

Embodiments of the invention can utilize shock cords of various diameter, tensile strength, and number enclosed within nylon sheath 800. FIG. 9 shows a preferred embodiment in which single 8 inch long shock cord 900 with a ¼ inch diameter is folded into a U-shape, slipped inside nylon sheath 800, and then sewn into section 360 with threads 810 that secure shock cord 900 and attach nylon sheath 800 to the attachment bars of side-release buckle 314 and snap hook 316. Incorporating a shock cord into the sling in this way facilitates the sewing process and provides for additional user comfort when compared to a single larger diameter shock cord. Using the configuration shown in FIG. 9 provides additional strength, stability, and comfort for the user compared to a single, larger diameter cord, which would be necessary to provide similar tensile strength. The U-shape configuration shown in FIG. 9 effectively provides two shock cords of smaller diameters, which increases the surface area by which the force of the sling is dispersed along the sling. This configuration has the additional benefit that section 360 will "lay down" or "flatten out" against the user for a more secure fit and provides for added durability over time as sling wear is more evenly distributed across the increased surface area.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A sling comprising:

a first spring hook connected to a first end of a strap;

a second spring hook connected to a first end of a first elastic cord section;

a transition link secured to a second end of said strap and a first end of a second elastic cord section;

a paracord section wherein a first end of said paracord section is connected to a second end of said second elastic cord section; and an adjustable strap section connected to a second end of said paracord section and a second end of said first elastic cord section.

2. The sling of claim 1 wherein said adjustable strap section is configured to detach from said second end of said paracord section and be mounted to body armor with said first elastic cord section and said second spring hook.

3. The sling of claim 1 wherein said strap further comprises a side-release buckle.

4. The sling of claim 1 wherein said adjustable strap section is connected to said first elastic cord section by a side-release buckle.

5. The sling of claim 1 wherein said paracord section is comprised of 550 paracord.

6. The sling of claim 5 wherein said paracord section is configured in a triple cobra weave configuration.

7. The sling of claim 1 wherein said adjustable strap section comprises a nylon strap and one or more slide buckles.

8. The sling of claim 1 wherein the said first and second elastic cord sections are comprised of a single shock cord bent into a U-shape and covered by a nylon web sheath.

9. The sling of claim 1 wherein said first and second elastic cord sections are between 5 inches and 6 inches long in an unstretched state.

10. The sling of claim 1 wherein said first and second elastic cord sections are between 9 inches and 10 inches long in a fully stretched state.

11. A sling comprising:

a first quick release mechanism connected to a first end of a strap;

a second quick release mechanism connected to a first end of a first elastic cord section;

a transition link secured to a second end of said strap and a first end of a second elastic cord section, said transition link comprising at least one mating quick release mechanism configured to attach to said second quick release mechanism;

a paracord section wherein a first end of said paracord section is connected to a second end of said second elastic cord section; and an adjustable strap section connected to a second end of said paracord section and a second end of said first elastic cord section.

12. The sling of claim 11 wherein said strap further comprises a side-release buckle.

13. The sling of claim 11 wherein said adjustable strap section is connected to said first elastic cord section by a side-release buckle.

14. The sling of claim 11 wherein said adjustable strap section comprises a nylon strap and one or more slide buckles.

* * * * *